United States Patent [19]

Redford

[11] Patent Number: 5,029,772

[45] Date of Patent: Jul. 9, 1991

[54] FILAMENT PAYOUT APPARATUS

[75] Inventor: Gary R. Redford, Tucson, Ariz.

[73] Assignee: Hughes Aircraft Company, Los Angeles, Calif.

[21] Appl. No.: 359,238

[22] Filed: May 31, 1989

[51] Int. Cl.[5] ..... F41G 7/32

[52] U.S. Cl. ..... 244/3.12; 89/1.34; 102/504

[58] Field of Search ..... 244/3.12; 102/504, 302; 89/1.811, 1.13, 1.34

[56] References Cited

U.S. PATENT DOCUMENTS 2,469,533 5/1949 Wellcome ..... 89/1
4,770,370 9/1988 Pinson ..... 244/3.12
4,817,529 4/1989 Schippers ..... 102/302

FOREIGN PATENT DOCUMENTS 3719908 12/1988 Fed. Rep. of Germany ..... 244/3.12

*Primary Examiner*—Charles T. Jordan
*Assistant Examiner*—Rochelle Lieberman
*Attorney, Agent, or Firm*—C. D. Brown; R. M. Heald; W. Denson-Low

[57] ABSTRACT

A drumlike canister onto which a filament is wound is rotatably mounted to an airborne vehicle, the axis of rotation being generally parallel to the vehicle longitudinal axis. At launch, as the filament unwinds and is payed out the canister is rotated to remove the twist from the filament produced on winding.

14 Claims, 1 Drawing Sheet

FILAMENT PAYOUT APPARATUS

BACKGROUND OF THE INVENTION

1. Field of the Invention

The present invention relates generally to filament payout apparatus, and, more particularly, to such apparatus as utilized in a missile for establishing a data link.

2. Description of Related Art

In a number of missiles, at launch an extent of a filament (e.g., wire or optical fiber) is payed out from the missile and interconnected with apparatus at launch site to provide a data link over which commands and navigational information are communicated. Especially if the filament consists of an optical fiber, it is important in paying out the fiber not to produce kinking or induce undue stress in the fiber since this may result in breakage, or, at the least, reduce the transmission quality.

A commonly employed form of payout apparatus consists of a generally drum-like member or canister fixedly mounted onto the missile with the filament helically wound about an axis parallel to the longitudinal axis of the missile. The drum, or canister, is immovable with respect to the missile so that as the fiber unwinds it results in an extended helix. This manner of payout produces a twist in the fiber which has been found to provide optical signal loss. In addition, there are some programs which require that the fiber not coil when it goes slack (i.e., that portion payed out from the vehicle) since the fiber could break if tension were suddenly applied.

Also, on these prior canisters the filament is wound in a helix at approximately 60 degrees to the direction of payout which means that there is a peel point at which the fiber is removed from the canister pack experiencing a substantial angular deformation. At this peel point the winding pack experiences a radial force with a direction toward the center of the pack and a magnitude that increases with the square of the vehicle velocity. It is desirable to reduce this radial force by rotating the canister, thereby, counteracting the velocity squared term. This radial force tends to disturb winding pack stability and can produce a failure mode known as "pop up".

Also, in the prior canisters, it has been found advisable to provide the canister with a decided taper from the forward to the aft end in order to reduce frictional force of the fiber on underlying layers as it is removed from the pack.

SUMMARY OF THE DISCLOSURE

It is a primary object and aim of the present invention to provide a canister for filament payout apparatus which rotates on filament pay out in order to remove the twist from the fiber and reduce the radial force during payout. More particularly, the canister on which the filament is helically wound is rotatively mounted to the vehicle with the axis of rotation preferably being parallel to the vehicle longitudinal axis. At launch, when filament payout begins, the canister is rotated optionally by utilizing the rocket motor, the missile air stream, or a dedicated engine.

DESCRIPTION OF THE PREFERRED EMBODIMENTS

Figure 1:
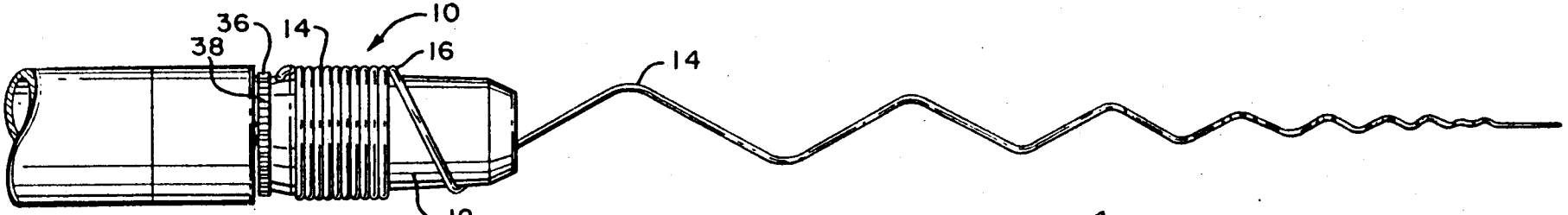
FIG. 1 is a side elevational view of a prior art missile canister on which a filament data link is wound showing a portion of the filament being payed out.

With reference now to the drawings and particularly FIG. 1, a prior art filament payout apparatus is enumerated generally as 10 and is seen to include a cylindrical drum or canister 12 on the circumferential periphery of which a quantity of filament 14 is laid down in a plurality of helically wound layers. More particularly, the canister axis is typically colinear with the longitudinal axis of the missile and has a taper from the forward to the aft end so that the diameter of the cannister at the aft end is smaller than that of the forward end. Also, the canister is immovably related to the missile body.

Figure 2:
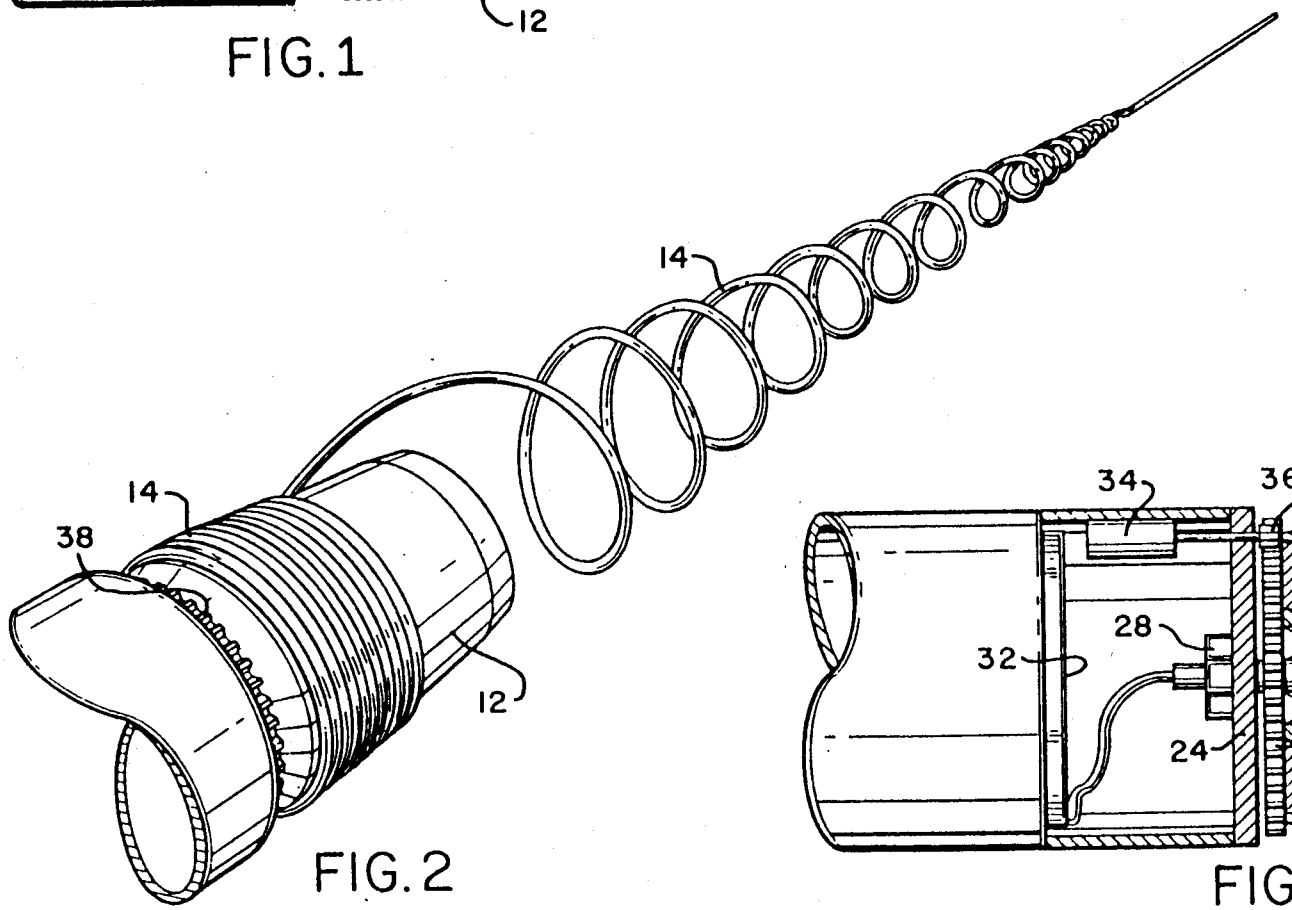
FIG. 2 is an end elevational, sectional view of the payed out filament of FIG. 1 depicting the twist that exists in the fiber.

The filament which is shown payed out from the aft end of the canister is an elongated or extended helix turning in the opposite direction as it was wound on the canister which can be seen by comparing FIGS. 1 and 2. This helical shape inherently produces a twist in the fiber which, in the event tension were to be established in the fiber after payout, would tend to kink the filament reducing optical signal transmission efficiency, or even break the fiber thereby severing the data link completely.

In order to maintain the stability of the wound filament pack, it is conventional to spray or otherwise apply a light adhesive to secure the windings together. Accordingly, in the region identified as 16 as the fiber is payed out there is a point at which it breaks the adhesive and peels from the pack resulting in a substantial angular turn or bend. This peeling from the pack induces a certain amount of stress into the fiber and is undesirable.

Still referring to FIG. 1, it is to be noted that as the fiber trails behind the canister, the helix diameter decays to zero and gives the appearance of a dampened wave oscillating about the longitudinal axis of the canister. This characteristic enables a relatively simple analysis to be made of the forces involved in paying out the filament in that they can be treated as a harmonic oscillator of frequency F and the helix can be projected into a simple two dimensional wave for the case of no dampening. The following set of equations as applied to this situation provide a mathematical statement of a payed out filament from which we can analyze the various forces acting on the filament:

$$Y = A \sin\left[\frac{2\pi t}{T} - \frac{2\pi x}{\lambda}\right] \tag{1}$$

For an instantaneous wave at t=0, the equation simplifies to, $$Y = A \sin - \left[\frac{2\pi x}{\lambda}\right] \tag{2}$$

Differentiating, the slope of the wave can be expressed by, $$\frac{dY}{dx} = -\frac{A\pi 2}{\lambda}\cos - \left[\frac{2\pi x}{\lambda}\right] \quad (3)$$

For the maximum slope, which is equivalent to the slope along the helix, the cosine is 1. Therefore, the equation reduces to, $$\frac{dY}{dx}\max = -\frac{A2\pi}{\lambda} \quad (4)$$

This reduces to, $$\frac{dY}{dx}\max = -\frac{A2\pi(Fc + Fp)}{Vw} \quad (5)$$

where,

Fc=canister frequency

Fp=a rotation peel point frequency

Vw=wave velocity

Equation (5) implies that on rotating the canister in a direction opposite that of the filament helix wound on the canister, that the frequency FC will increase in the negative direction. Also, the sum of FC plus FP will approach zero when the rotation of the filament canister is equal and opposite to the rotation of the helix and therefore the slope of the filament or peel-off to the next remaining winding goes to zero. Accordingly, filament payout under these conditions will result in the filament making a 90-degree bend at the peel point, and the helical twist of the payed out filament is removed entirely so that the radial force goes to zero. Also in this case, the peel point radius will be controlled entirely by the stiffness of the filament.

Upon analyzing the situation indicated by equation (5) when the canister is rotated in the same direction as the wound helix, as the slope becomes very large the peel bend radius approaches no bend at all. That is, the filament on being payed out is subjected to substantially no, or very little, bend stress as it is removed from the wound pack.

Figure 3:
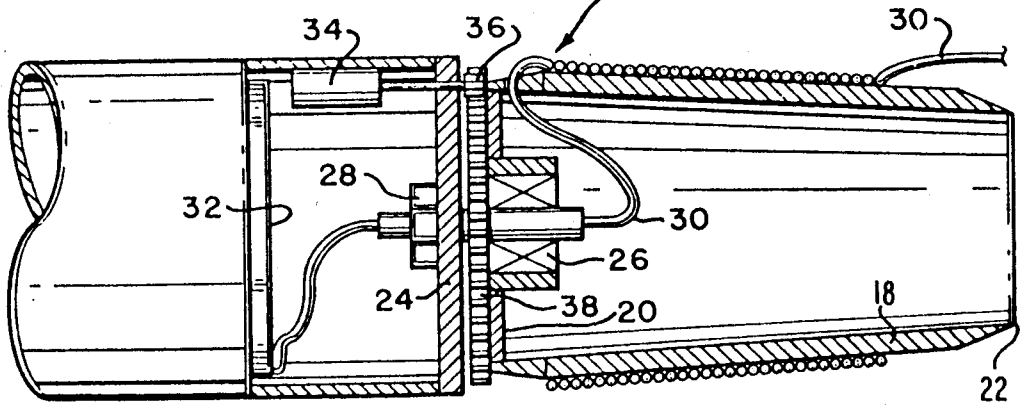
FIG. 3 is a side elevational, sectional view of a canister filament payout apparatus of the present invention shown in the midst of filament payout.

It is fundamental to the present invention to overcome the difficulties encountered with paying out a filament from a fixed canister by rotating the canister. As shown in FIG. 3, the payout apparatus 17 of the present invention is seen to include a generally cylindrical canister 18 having a closed inner end 20 and an open outer end 22. The canister is journaled to a missile transverse end wall 24 via a bearing 26 with the canister longitudinal axis arranged to be substantially colinear with the missile longitudinal axis. A rotary connector 28 is unitarily secured to the canister closed inner end 20 and extends through the end wall 24 for a purpose to be described. Rotary connectors are well known in the optical fiber art and consist generally of a pair of rotatable parts holding separate glass fibers with their respective ends aligned and slightly spaced apart.

Specifically, the canister peripheral wall is tapered from a maximum diameter at the wall 20 to a minimum diameter at the outer open end 22. In use, a filament 30 of predetermined length is wound onto the canister in a series of layers with an inner end portion extending through an opening in the canister wall (not shown) and connected with a circuit board 32, for example, on board the missile by the rotary connector 28. To insure stability of the filament pack wound on the canister a light adhesive may be sprayed or otherwise applied to the filament.

A rotative power source 34 is selectively actuatable to rotate the canister via a spur gear 36 meshing with a set of gear teeth 38 on the canister periphery. Optionally, the rotative power source can be a dedicated electric motor, derived from the rocket motor, or the air stream adjacent the missile.

On launch, the filament begins to pay out immediately. Also, at this same time, the power source 34 begins to rotate the canister, preferably in the opposite direction as the filament helix, and at a rate sufficient to remove all of the twist from the filament so that it will trail behind the missile in a substantially torsionless state.

Although the invention has been described in connection with a preferred embodiment, it is to be understood that one skilled in the appertaining art may make modifications therein that will come within the spirit of the invention. For example, the canister axis may be arranged parallel to the missile axis but eccentric to it.

I claim:

1. A filament payout apparatus for a vehicle, comprising:

a generally cylindrical means for carrying a length of filament wound on the peripheral surface thereof, the cylindrical means having an axis and a closed end, the cylindrical means also includes a filament rotary connector passing through the closed end and being generally aligned with the axis;

means for rotatably mounting the cylindrical means to the vehicle; and means for rotatively driving the cylindrical means about the axis during filament payout.

2. Filament payout apparatus as in claim 1, in which the cylindrical means is hollow with an open end, the circumferential periphery tapering from a maximum at the closed end to a minimum at the open end.

3. Filament payout apparatus as in claim 1, in which the cylindrical means is rotated about an axis generally colinear with the vehicle.

4. Filament payout apparatus as in claim 1, in which the cylindrical means is rotated about the axis generally parallel to and eccentric from the vehicle.

5. Filament payout apparatus as in claim 1, in which the means for rotatively driving the cylindrical means is a dedicated motor.

6. Filament payout apparatus as in claim 1, in which the means for rotatively driving the cylindrical means derives its power from the vehicle drive.

7. Filament payout apparatus as in claim 1, in which the means for rotatively driving the cylindrical means derives its power from a medium through which the vehicle moves.

8. Filament payout apparatus as in claim 1, in which the filament is an optical fiber.

9. Filament payout apparatus as in claim 1, in which the filament is a metal wire.

10. A filament payout apparatus for a vehicle such as a missile, comprising:

a hollow cylindrical means for carrying a length of filament wound on the peripheral surface thereof, said means having a closed end, the cylindrical means also includes a filament rotary connector passing through the closed end and being generally aligned with the axis, the means circumferential periphery tapering from a maximum at the closed end to a minimum at the other end thereof, means for journaling the cylindrical means within the vehicle for rotation about an axis generally colinear with the vehicle; and means for rotatively driving the cylindrical means during filament payout.

11. Filament payout apparatus as in claim 10, in which the cylindrical means is rotated about an axis generally parallel to and eccentric from the vehicle.

12. Filament payout apparatus as in claim 10, in which the means for rotatively driving the cylindrical means is a dedicated electrical motor.

13. Filament payout apparatus as in claim 10, in which the means for rotatively driving the cylindrical means derives its power from a vehicle drive.

14. Filament payout apparatus as in claim 10, in which the means for rotatively driving the cylindrical means derives its power from an airstream through which the vehicle moves.

* * * * *